US006805299B1

(12) United States Patent
Wasmer et al.

(10) Patent No.: US 6,805,299 B1
(45) Date of Patent: Oct. 19, 2004

(54) FOUNTAIN AERATOR WITH FLOW STRAIGHTENER

(75) Inventors: David E. Wasmer, New Holstein, WI (US); Brian J. Hanke, Chilton, WI (US)

(73) Assignee: Nigrelli Systems, Inc., Kiel, WI (US)

( * ) Notice: Subject to any disclaimer, the term of this patent is extended or adjusted under 35 U.S.C. 154(b) by 0 days.

(21) Appl. No.: 10/456,731

(22) Filed: Jun. 6, 2003

(51) Int. Cl.[7] ..... B05B 17/08
(52) U.S. Cl. ..... 239/17
(58) Field of Search ..... 239/16, 17, 23, 239/463, 483, 484

(56) References Cited

U.S. PATENT DOCUMENTS

| | | | | |
|---|---|---|---|---|
| 3,416,729 A | * | 12/1968 | Ravitts et al. | 239/16 |
| 3,735,926 A | | 5/1973 | Ravitts | |
| 4,844,341 A | | 7/1989 | Alba | |
| 4,981,622 A | | 1/1991 | Nigrelli et al. | |
| 5,011,372 A | | 4/1991 | Nigrelli et al. | |
| 5,069,387 A | | 12/1991 | Alba | |
| 5,549,010 A | * | 8/1996 | Park et al. | 73/861.79 |
| 5,711,657 A | | 1/1998 | Hoffmeier | |
| 5,718,379 A | | 2/1998 | Cramer | |
| 5,931,382 A | | 8/1999 | Gross et al. | |
| 6,241,221 B1 | * | 6/2001 | Wegner et al. | 261/93 |

* cited by examiner

*Primary Examiner*—Denise L. Esquivel
*Assistant Examiner*—Malik N. Drake
(74) *Attorney, Agent, or Firm*—Andrus, Sceales, Starke & Sawall, LLP

(57) ABSTRACT

A fountain aerator for propelling and aerating water includes a float having a flow tube extending therethrough for suspending the aerator in a body of water. A motor base assembly contains a motor provided with a rotatable output shaft. An open ended housing is spaced from the float and connected between the flow tube and the motor base assembly. A wear ring is secured within the housing and defines a central opening therein. A covered impeller is retained in the housing in spaced relationship with the float and is coupled to the motor output shaft for rotation therewith. The impeller has a series of radially extending blades which define a series of outlet passages in communication with the inlet. A flow straightener is spaced from the float and fixed to the housing in overlying, surrounding relationship with the impeller. The flow straightener has flow straightening slot structure overlapping the outlet passages of the impeller for propelling substantially vertical streams of water upwardly through the flow tube.

29 Claims, 6 Drawing Sheets

FIG. 5
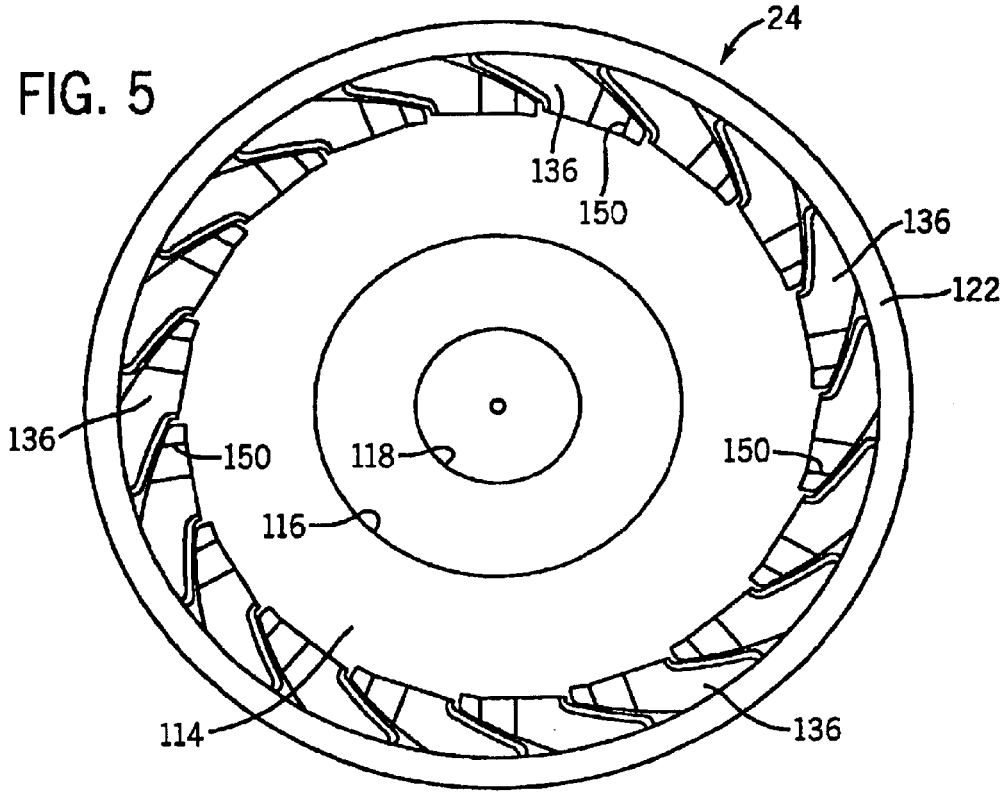
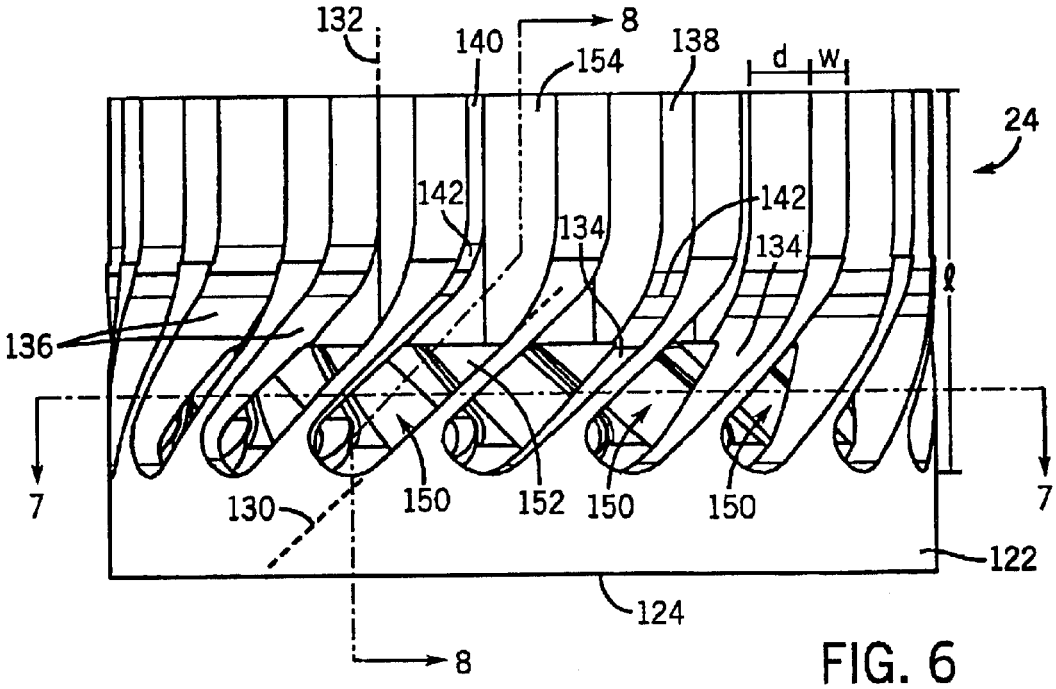
FIG. 6

FIG. 7
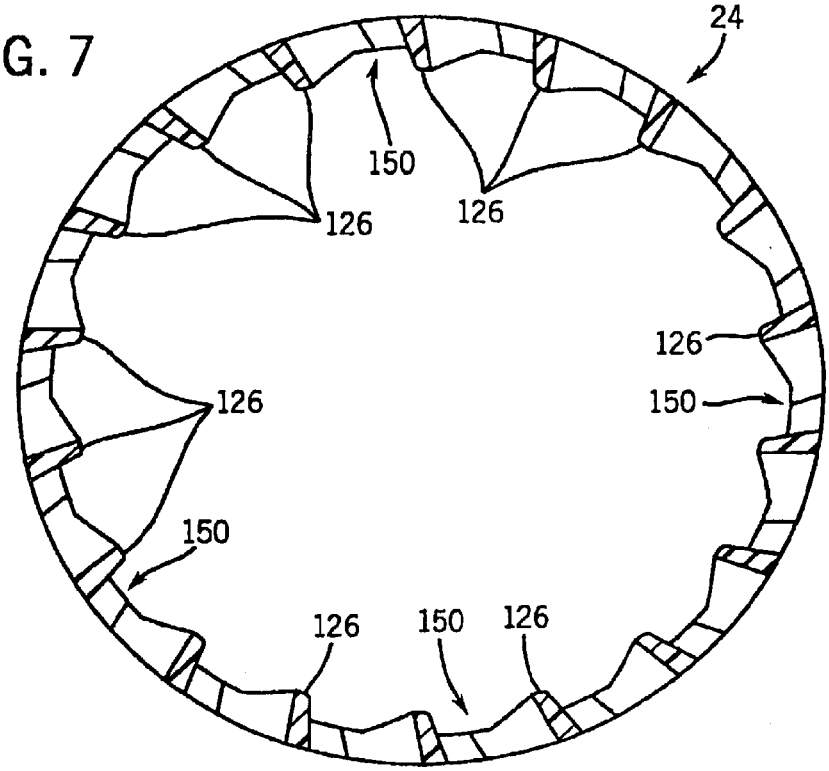
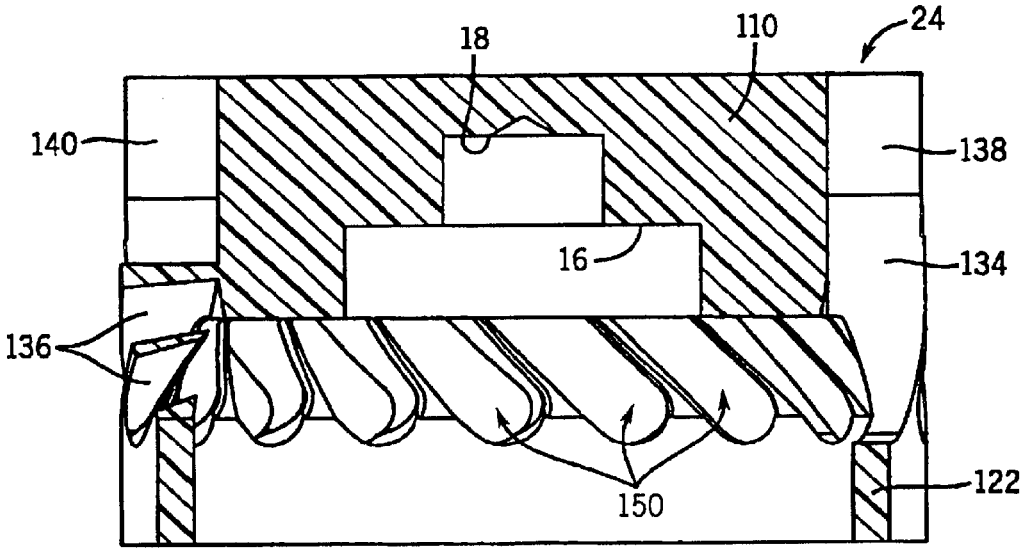
FIG. 8

FOUNTAIN AERATOR WITH FLOW STRAIGHTENER

FIELD OF THE INVENTION

The present invention relates broadly to a fountain aerator of the motordriven type which creates aeration by aesthetically spraying water into the air. More particularly, the present invention pertains to a floating fountain aerator employing a particular arrangement of components which will enable water to be simultaneously propelled and aerated in greater volumes with increased flow rates and vertical height using less power then prior known devices.

BACKGROUND OF THE INVENTION

Using floating fountains to provide water aeration is a common practice. For example, it is known to pump water from a pond or lagoon generally vertically into the air. As the water drops back to the pond, it forms a spray of droplets that absorb oxygen. This practice helps keep the pond high in dissolved oxygen which is especially beneficial to industry and municipalities for aerobic water and sewage treatment processes. The continuing cycle of oxygen circulation supports aerobic bacterial action resulting in clearer, cleaner odor-free water. In addition to performing a biological function, a column or fountain of water also has high aesthetic appeal. For those reasons, many parks and commercial buildings are landscaped with ponds having water fountains.

One example of an aerating water fountain is disclosed in U.S. Pat. No. 5,931,382 issued Aug. 3, 1999 to Gross et al. In this patent, a fountain has a float with an aperture running through its center, and a propeller-like recouperator is mounted in the bottom of the aperture. The fountain also has an electric motor with an open blade-type impeller and housing therefor coupled to its shaft. The motor is mounted to the float such that the impeller is located beneath the recouperator and immediately adjacent to the bottom of the float aperture. A nozzle plate is releasably coupled to a top side of the float in such a manner that it may be adjusted to bring a different nozzle into alignment with the float aperture. While the Gross et al. patent provides for a quick and easy changing of the nozzle and resulting water spray pattern, the individual design of and collective arrangement of its components can be improved so as to enhance the overall pumping performance of the fountain.

SUMMARY OF THE INVENTION

It is a general object of the present invention to provide a differently-styled, ornamental fountain aerator which is capable of producing greater outputs of water at greater heights with a reduced amount of power.

It is also an object of the present invention to provide a fountain aerator which employs a unique flow straightener in combination with a closed-type impeller and a wear ring.

It is an additional object of the present invention to provide a fountain aerator which does not rely upon a centrifugal pump, a propeller or a diffuser.

In one aspect of the invention, a fountain aerator for propelling and aerating water includes a float having a flow tube extending therethrough for suspending the aerator in a body of water. A motor base assembly contains a motor provided with a rotatable output shaft. An open-ended housing is spaced from the float and is connected between the flow tube and the motor base assembly. A wear ring is secured within the housing and defines a central opening therein. A covered impeller is retained in the housing in spaced relationship with the float, and is coupled to the motor output shaft for rotation therewith. The impeller has an upper wall and a lower wall interconnected by a number of radially extending blades. The impeller also-has a water admitting inlet depending from the lower wall and extending through the central opening for rotation therein. The upper wall, the lower wall and the blades define a series of outlet passages in communication with the inlet. With this construction, the impeller creates centrifugal output streams of water when the motor output shaft rotates, and the wear ring minimizes return flow of water through the inlet.

The impeller includes a central hub for receiving the motor output shaft. Each of the blades is curved and has an inner end located between the hub and the inlet, and an outer end positioned between the upper wall and the lower wall. Each of the blades sweeps outwardly and upwardly from the inner end to the outer end. The flow tube has an upper end projecting above the float, and a lower end projecting beneath the float. The motor base assembly includes a support stand extending upwardly therefrom. The housing has a top open end connected to the lower end of the flow tube, and a bottom open end attached to the support stand. The wear ring is secured within the bottom open end of the housing. A bottom wall of the wear ring is substantially flush with a bottom end of the impeller inlet.

In another aspect of the invention, a fountain aerator for propelling and aerating water includes a float having a flow tube extending therethrough for suspending the aerator in a body of water. A motor base assembly contains a motor provided with rotatable output shaft. An open ended housing is spaced from the float and connected between the flow tube and the motor base assembly. A wear ring is secured within the housing and defines a central opening therein. A covered impeller is retained in the housing in spaced relationship with the float and is coupled to the motor output shaft for rotation therewith. The impeller has an upper wall and a lower wall interconnected by a number of radially extending blades. The impeller also includes a water admitting inlet depending from the lower wall and extending through the central opening for rotation therein. The upper wall, the lower wall and the blades define a series of outlet passages in communication with the inlet. A flow straightener is spaced from the float and is fixed to the housing in overlying, surrounding relationship with the impeller. The flow straightener has flow straightening slot structure overlapping the outlet passages of the impeller for propelling substantially vertical streams of water upwardly through the flow tube.

The flow straightener is crown-shaped and includes an upper portion and outer wall encircling the upper portion. The upper portion is recessed to rotatably receive an enlarged top section of the impeller. The outer wall is formed with a plurality of spaced apart, angularly and upwardly extending fingers defining the slot structure between adjacent pairs of fingers. The outer wall has a lower, solid ring portion defining a bottom end of the flow straightener which rests upon the wear ring and lies adjacent an inner surface of a bottom end of the housing. Each finger has an angular segment disclosed at generally a 45 degree angle relative to the bottom end of the flow straightener, and a vertical segment extending at generally a 90 degree angle relative to the bottom end of the flow straightener. Each finger has a width and a length which is greater than its width. The angular segment of each finger has identically-shaped opposed surfaces which increase in depth as the angular segment progresses upwardly toward the vertical segment. The vertical segment of each finger has opposed surfaces which diverge from each other in a radial direction. The slot structure includes a number of flow straightening slots extending generally axially of a longitudinal axis of the flow straightener. Each of the slots has an angular portion and a vertical portion extending from the angular portion. The angular portions of the slots overlie the outlet passages of the impeller. The impeller blades have outer ends that extend across the angular portions of the slots.

In yet a further aspect of the invention, a fountain aerator flow straighter is adapted to straighten the centrifugal flow of water emanating from a rotatable impeller. The flow straighter includes a crown-shaped body having a cylindrical upper portion and a cylindrical outer wall encircling the upper portion. The body is adapted to overlie and surround the impeller. The upper portion is recessed and adapted to rotatably receive an enlarged top section of the impeller. The outer wall is formed with a plurality of flow straightening, angularly and upwardly extending slots adapted to overlap outlet passages of the impeller. The slots are constructed and arranged to carry and transport increasing volumes of water as the paths of the slots proceed upwardly.

The slots extend generally axially of the longitudinal axis of the flow straightener. The slots are formed by a number of flow straightening fingers. Each finger has an angular segment disposed at a 45 degree angle relative to a bottom end of the flow straightener, and a vertical segment extending at a generally 90 degree angle relative to the bottom end of the flow straightener. Each finger has a width and a length which is greater than its width. The angular segment of each finger has identically-shaped, opposed surfaces which increase in surface area as the angular segment progresses upwardly toward the vertical segment. The vertical segment of each finger has opposed surfaces which diverge from each other in a radial direction. Each slot has an angular portion and a vertical portion extending from the angular portion. Each angular segment opposed surface is connected to each vertical segment opposed surface by a radiused area.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 5 is a bottom view of the flow straightener in FIG. 4;

FIG. 6 is an elevational view of the flow straightener in FIG. 4;

FIG. 7 is a sectional view of the flow straightener taken on line 7—7 of FIG. 6;

FIG. 8 is a sectional view of the flow straightener taken on line 8—8 of FIG. 6.

DETAILED DESCRIPTION OF THE INVENTION

Figure 1:
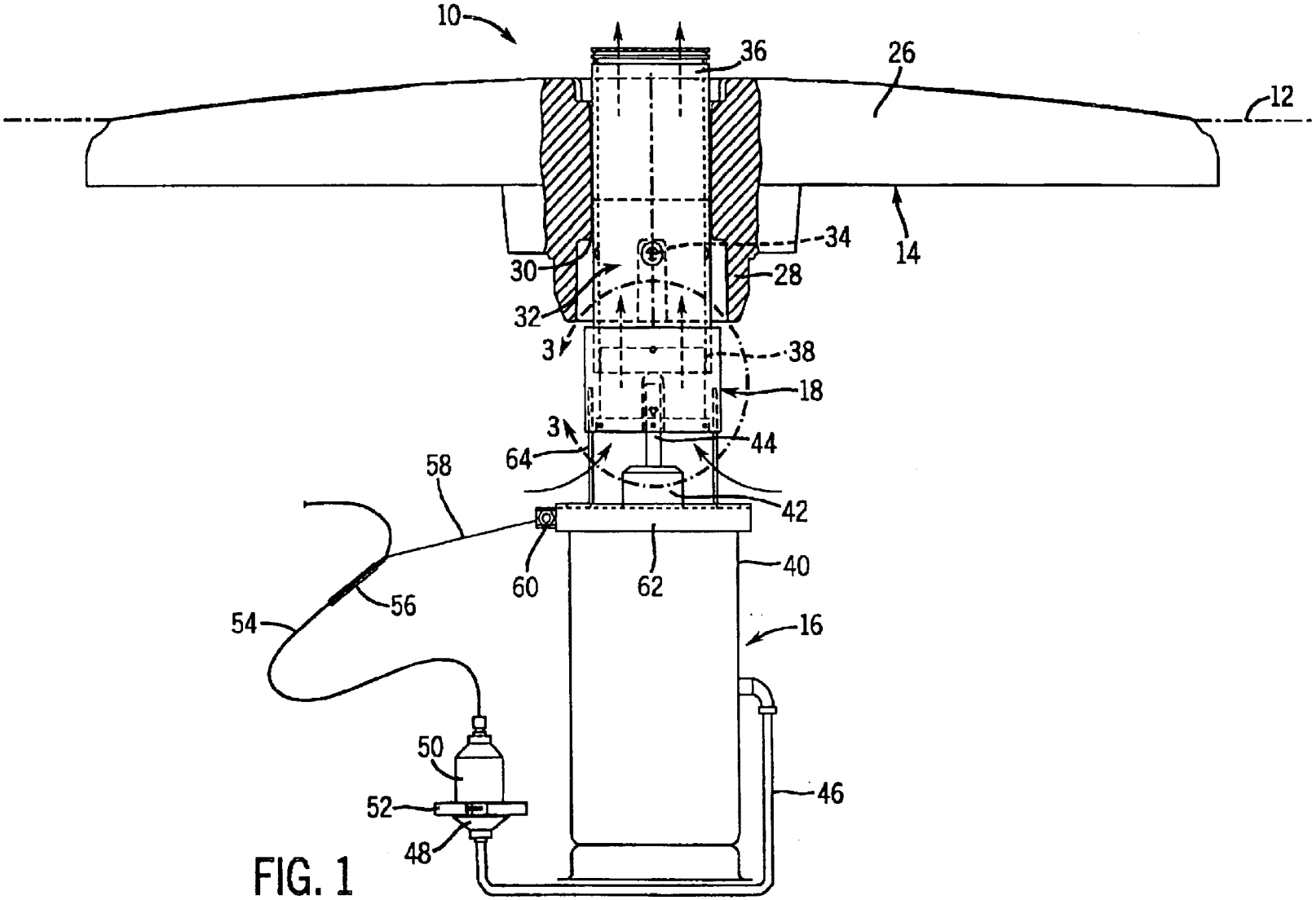
FIG. 1 is an elevational view, in-partial cross section, of a fountain aerator embodying the present invention.
Figure 2:
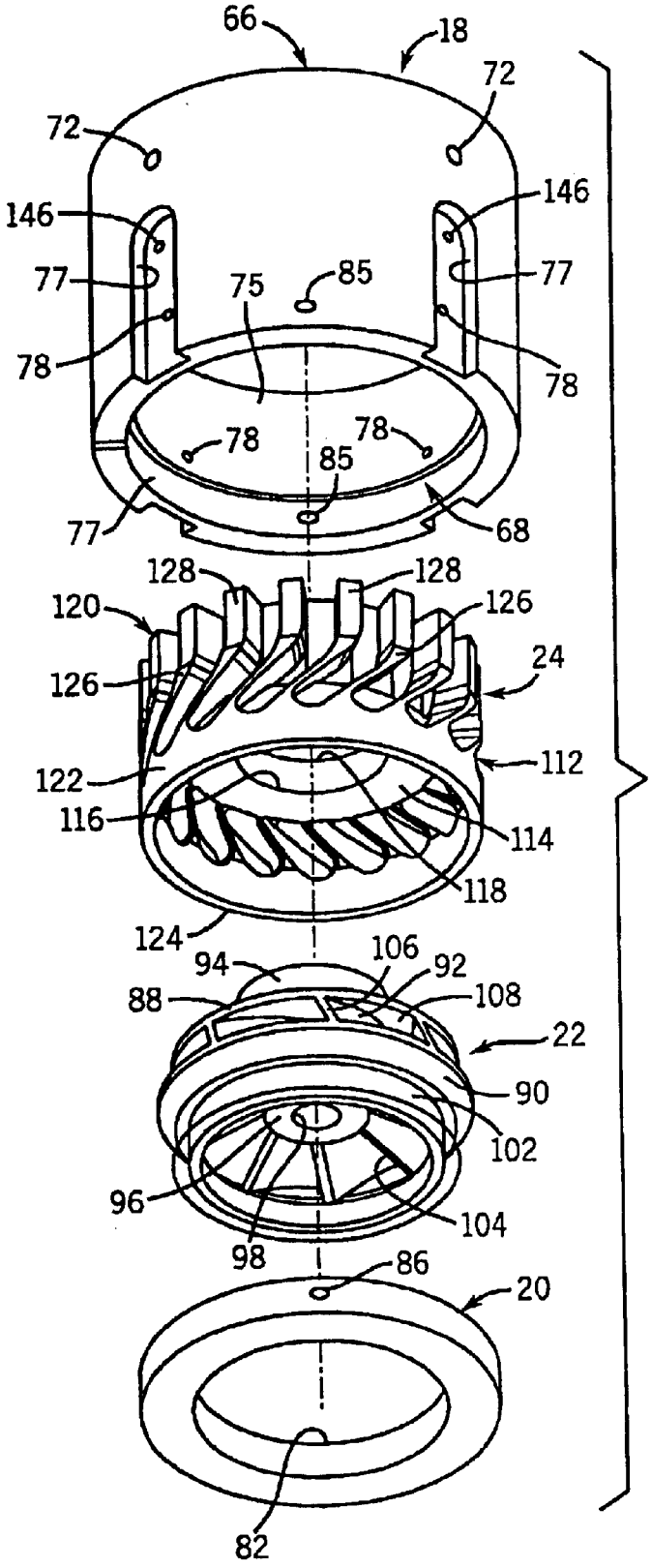
FIG. 2 is an exploded, bottom perspective view of the housing, the flow straightener, the impeller and the wear; ring used in the fountain aerator of FIG. 1.

Referring to FIGS. 1 and 2, a fountain aerator 10 is illustrated that embodies the present invention. The fountain aerator 10 is particularly useful for enhancing the aesthetics of an outdoor pond, lagoon or other body of water 12. The invention also is extremely useful for the aerobic treatment of inferior quality water.

Generally, the fountain aerator 10 is comprised of a float 14, a motor base assembly 16, and an open ended housing 18 containing a wear ring 20, an impeller 22 and a flow straightener 24.

The float 14 includes an upper portion 26 which extends radially outwardly from a central portion 28 formed with a throughhole 30. The throughhole 30 receives a cylindrical flow tube 32 fixed to the central portion 28 by fasteners such as shown at 34. The flow tube 32 has an upper end 36 projecting slightly above the top of the upper portion 26, and a lower end 38 which extends beneath the bottom of the central portion 28. Although not shown, the upper end 36 of the flow tube 32 is typically provided with nozzle structure for controlling the resulting spray pattern of water propelled from the flow tube 32. The fountain aerator 10 is designed such that when placed in the pond 12, it submerges to the point where the top of the float upper portion 26 and the upper end 36 of the flow tube 32 lies just above the pond surface. The float 14 also serves to support the remaining components of the fountain aerator 10 therefrom.

The motor base assembly 16 provides a motive arrangement for rotating the impeller 22 such that water drawn from the pond 12 may be forcefully propelled through the flow tube 32. The motor base assembly 16 includes an oil-filled base 40 for mounting an electric motor 42 having an output shaft 44 extending therefrom. A conductor 46 runs from the base 40 to a connector 48 which is removably attached to a cable disconnect device 50 by means of a clamp 52. A cable 54 has one end attached to the disconnect device 50 and an opposite end connected to a source of electric power located outside the pond 12. A cable support grip 56 is included in the cable. 54 and is tethered by a line 58 to an S-hook 60 on a base clamp 62 at the top of the base 40. The base clamp 62 facilitates the attachment of a rigid support stand 64 rising upwardly from the base 40. Although not illustrated, the stand 64 is normally surrounded by an intake screen which serves to filter out large foreign particles and debris as water drawn from the pond 12 is admitted therethrough.

Figure 3:
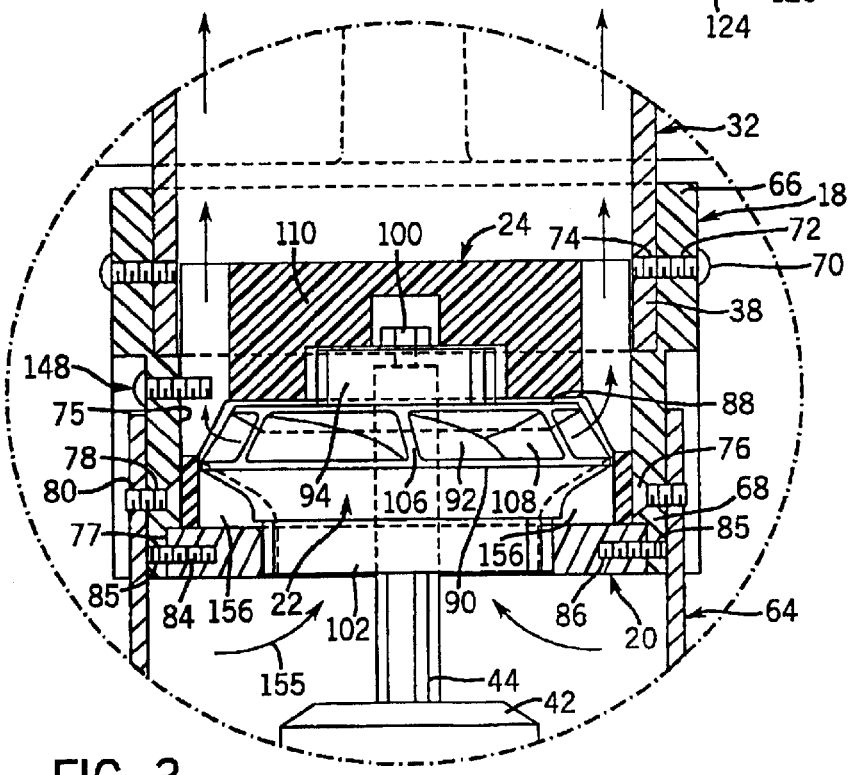
FIG. 3 is a detailed, sectional view taken on line 3—3 of FIG. 1.

Referring now to FIGS. 2 and 3, the housing 18 is cylindrically configured and includes a top open end 66 and a bottom open end 68. The top open end 66 is fixedly connected to an external surface on the lower end 38 of the flow tube 32 by fasteners 70. The fasteners 70 are passed through suitable housing openings 72 and screwed into threaded openings 74 formed in the flow tube 32. The bottom open end 68 includes an inner wall 75 having a first diameter. A channel 77 is recessed from the inner wall 75 and has a diameter greater than the diameter of the inner wall 75.

The bottom end 68 is securely joined by fasteners 76 to an internal surface on the upper end of the support stand 64 which is received in slots 77 provided in an outer wall of housing 18. The fasteners 76 are inserted through suitable housing apertures 78 and screwed into threaded apertures 80 formed in the support stand 64. When the housing 18 is fixed in position, the respective inner walls of the flow tube 32 and the housing 18 are substantially coplanar with one another so as to define a flow conducting surface.

The wear ring 20 is a cylindrical member formed with a central opening 82 therethrough for receiving a lower end of the impeller 22 and controlling water flow to and from the impeller 22. The central opening 82 has a second diameter that is less than the diameter of the inner wall 75 of the housing 18, as shown in FIG. 3. The wear ring 20 is secured within the bottom open end 68 of the housing 18 by fasteners 84 which are passed through suitable housing holes 85 and are turned into threaded holes 86 extending inwardly from the periphery of the wear ring 20.

The impeller 22 is retained in the housing 18 in spaced relationship from the float 14, and is operably connected to the motor 42 such that its rotating motion will draw in water from the pond 12 and create centrifugal output streams of water from the impeller periphery. As seen best in FIGS. 2 and 3, the impeller 22 is of the closed or covered-type having a dished upper wall 88 and a dished lower wall 90 interconnected by a number of radially extending blades 92. The upper wall 88 has an enlarged top section 94 which surrounds a central hub 96 having a passage 98 formed therethrough. The output shaft 44 of the motor 42 extends through the passage 98 and is rigidly connected to the hub 96 by means of a bolt 100 threaded into the top of the output shaft 44. With this connection, rotation of the output shaft 44 will result in simultaneous rotation of the impeller 22 relative to the fixed housing 18. The impeller 22 also has a water admitting inlet 102 depending from the lower wall 90 and extending through the central opening 82 of the wear ring 20 for rotation therein. With the impeller 22 suspended in position upon the output shaft 44, the bottom end of the inlet 102 is substantially flush with a bottom wall of the wear ring 20.

Each of the impeller blades 92 is curved and has an inner end 104 located between the hub 96 and the inlet 102, and an outlet end 106 positioned between the upper wall 88 and the lower wall 90. Each of the blades 92 sweeps upwardly and outwardly from the inner end 104 to the outer end 106. The upper wall 88, the lower wall 90 and the blades 92 define a series of relatively wide, outlet passages 108 which are in communication with the inlet 102. In the preferred embodiment, the impeller 22 has seven outlet passages 108 equally spaced about its periphery, but this design may vary as desired for the particular application. As will be explained more fully, it has been found that the closed impeller 22 provides improved flow rates resulting in vertical water fountains of greater heights with reduced motor horsepower when compared with the performance of an open blade type propeller/impeller driven by a motor at greater horsepower.

Figure 9:
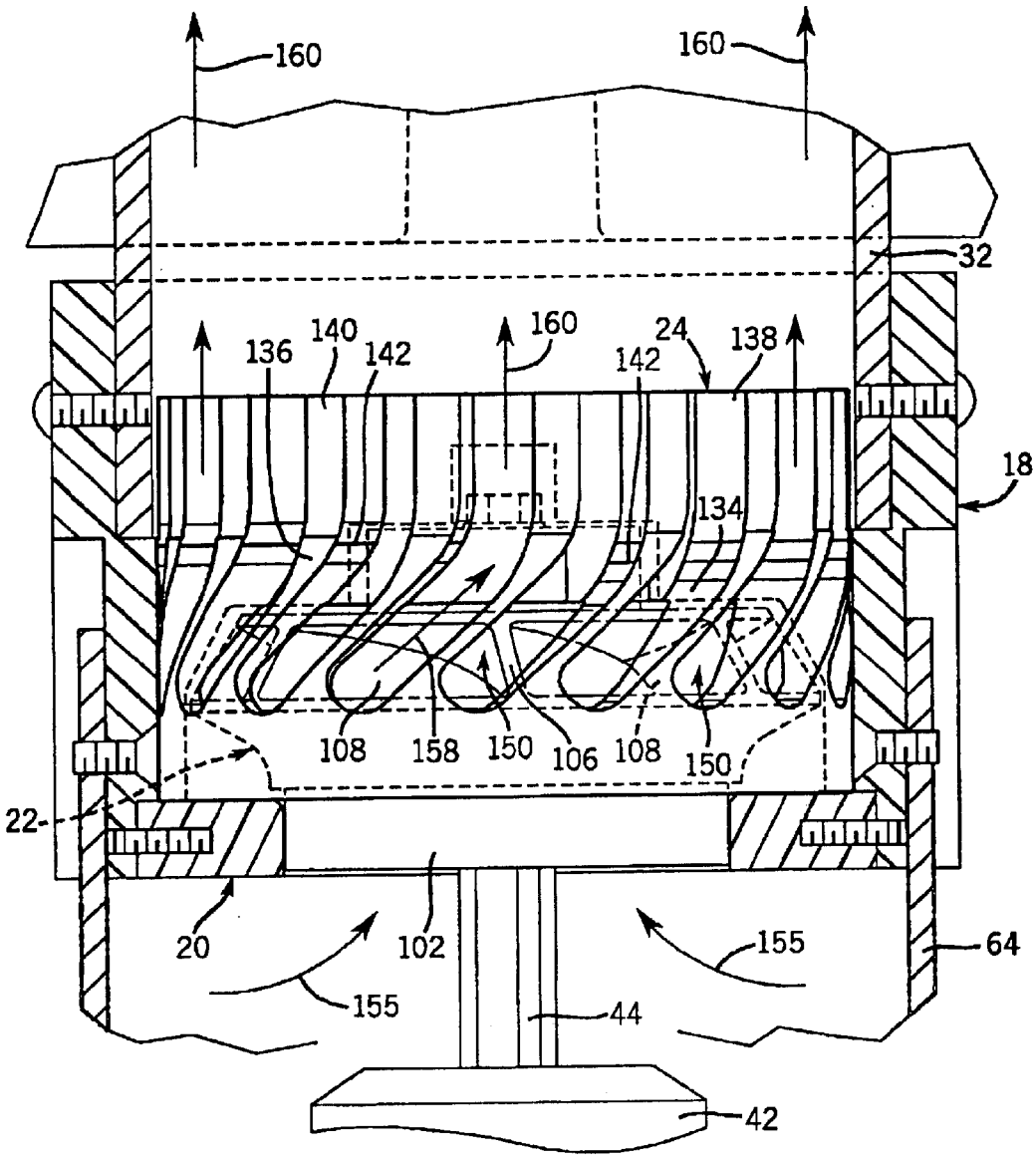
FIG. 9 is an enlarged view similar to FIG. 3 showing the relationship between the impeller and the flow straightener.

The flow straightener 24, as seen in FIGS. 3 and 9, is spaced beneath the float 14 and fixed to the housing 18 in overlying and surrounding relationship with the impeller 22. It is the purpose of the flow straightener 24 to eliminate the angular velocity component of the water as the water centrifugally leaves the outlet passages 108 of the impeller 22, and generally minimize turbulence in the fountain aerator 10. The flow straightener 24 is uniquely designed to propel the water in a straight vertical direction from the upper end 36 of the flow tube 32 at greater heights than obtained with the impeller 22 acting by itself.

The flow straightener 24 illustrated in FIGS. 2–9 has a crown-shaped body and includes a solid, upper cylindrical portion 110 and a cylindrical outer wall 112 generally encircling and extending radially from the upper portion 110. As seen in FIGS. 3, 5 and 8, the upper portion 110 has a bottom wall 114 formed with a first recess 116 for receiving the enlarged top section 94 of the impeller 22. The recess 116 is oversized so as to permit the impeller top section 94 to rotate relative to the fixed flow straightener 24. A second recess 118 is formed in the planar wall defining the first recess 116 for accommodating the bolt 100 securing the impeller hub 96 to the motor output shaft 44. The outer wall 112 is formed with a plurality of spaced apart, angularly and upwardly extending fingers 120 defining flow straightening slot structure between adjacent pairs of fingers 120. As will be further described, the fingers 120 are particularly shaped so as to channel water along a preferred gradually turned path. The outer wall 112 also includes a lower, solid ring portion 122 defining a bottom end 124 of the flow straightener 124 which rests upon the wear ring 20 and lies adjacent an inner surface at the bottom end 68 of the housing 18. As appreciated from FIG. 3, the flow straightener 24 is sized such that there is minimal clearance between the rotating periphery of the planar portion of the impeller lower wall 90 and an inside, upper surface of the solid ring portion 122.

Referring to FIG. 6, each finger 120 has an angular segment 126 disposed at generally a 45 degree angle relative to the bottom end 124 of the flow straightener 124, and a vertical segment 128 extending at generally a 90 degree angle relative to the bottom end 124 of the flow straightener 24. The vertical segments 128 may be seen to extend radially and directly from the upper portion 110. Dotted line 130 represents the 45 degree orientation of the angular segment 126 while dotted line 132 signifies the 90 degree orientation of the vertical segment 128. Each finger 120 has an overall length L which is greater than its width w which increases as the finger 120 proceeds upwardly. In addition, FIGS. 4, 6 and 7 show that the angular segment 126 of each finger 120 has identically-shaped, opposed surfaces 134, 136 which increase radially in depth d as the angular segment 126 proceeds upwardly towards the vertical segment 128.

Figure 4:
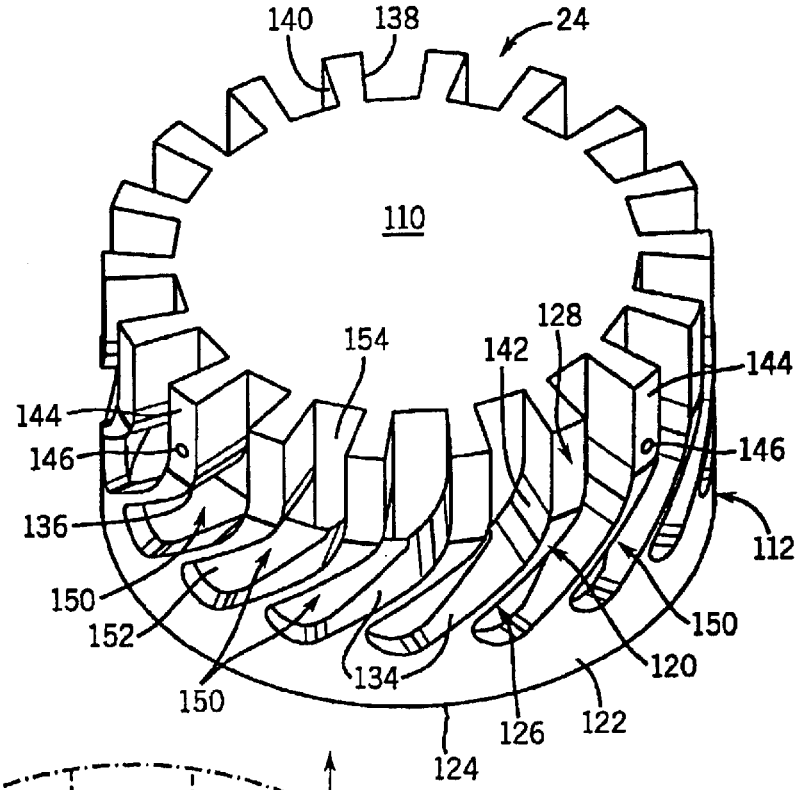
FIG. 4 is a top perspective view of the flow straightener.

As seen in FIG. 4, the vertical segment 128 of each finger 120 has opposed surfaces 138, 140 which diverge from each other in a radial direction. It is important to note that the radiused areas 142 enable a smooth transition between the angular segment surfaces 134, 136 and the vertical segments surfaces 138, 140 so as to prevent an abrupt change in flow as the angular velocity component of the water is eliminated. Certain outer faces 144 of the vertical segments 128 are formed with threaded holes (two being shown at 146 in FIGS. 2 and 4). As depicted in FIG. 3, fasteners of the type shown at 148 are passed through suitable holes in the housing 18 and are screwed into the threaded holes 146 so as to anchor the flow straighter 24 in the housing 18 over and around the impeller 22. The slot structure defined by the fingers 120 includes a number of identical flow straightening slots 150 which extend generally axially of the longitudinal axis of the flow straightener 24. In the preferred embodiment, 18 slots 150 are equally spaced at 20 degree increments around the periphery of the upper portion 110. Similar to the finger structure, each slot 150 has an angular portion 152 and a vertical portion 154 extending from the angular portion 152. The angular portions 152 of the slots 120 laterally overlap or overlie and communicate with the outlet passages 108 of the impeller 22 as best understood in FIG. 9. It can also be seen that the outer ends 106 of the impeller blades 92 extend across: the angular portions 152 of the slots 120.

In order to describe the operation of the fountain aerator 10, reference is made to FIGS. 3 and 9. When the motor 42 is energized, the output shaft 44 and the impeller 22 rotate to create a water output stream. Water in the pond 12 is drawn in by the impeller 22 in the direction of arrows 155 and passed along the bottom of the wear ring 22 and through the impeller inlet 102, and then swirled around the blades 92 and into the outlet passages 108. The impeller 22 imparts radial and tangential components of motion to the water thereby slinging the water outwardly with centrifugal force and angular velocity into the angular portions 152 of the slots 150. During this motion, any water which tends to recirculate downwardly between the periphery of the impeller 22 and the inside surface of the flow straightener ring portion 122 is substantially blocked from returning back to the pond 12 by the wear ring 20. Any accumulation of water in the chamber 156 between the impeller 22, the flow straightening ring portion 126 and the top of wear ring 20 is eventually drawn upwardly for delivery into the slots 150 of the flow straightener 24.

Water entering the slots 150 in FIG. 9 is channeled along the opposed surfaces 134, 136 of the angular segments 126 which increase in surface area as the flow proceeds upwardly. The radiused areas 142 are critical in allowing the flow to gradually turn from the 45 degree path shown by arrow 158 to the 90 degree path shown by the arrow 160 along the opposed surfaces 138, 140 of the vertical segments 128 and thereby minimize turbulance. Because of the shape of the surfaces 134 through 140, the volume of the water flow increases as the water moves progressively through the slots 150. Vertical columns of water are accelerated upwardly from the top of the slots 150 and propelled forcefully along the interior walls of the flow tube 32. Because there are no centrifugal forces, the water columns tend to fill the interior of the flow tube 32 ejecting any air residing therein. When the propelled water emerges from the upper end 36 of the flow tube 32, it will be delivered through nozzle structure so as to produce the desired fountain spray pattern. As the water droplets pass through the atmosphere before falling back to the pond 12, they absorb oxygen as well as provide aesthetic appeal.

While the preferred embodiment discloses a fountain aerator 10 employing the wear ring 20, the impeller 22 and the flow straightener in combination within the housing 18, it should be appreciated that the fountain aerator 10 will also work effectively in some applications with just the wear ring 20 and the impeller 22 in the housing 18. In such case, the centrifuigal output streams (FIG. 3) from the outlet passages 108 of the impeller 22 are delivered directly upwardly along the coplanar surfaces of the housing 18 and the flow tube 32. As a result, the water travels in a generally helical path out of the flow tube 32 and through the nozzle structure.

Testing has shown that using the impeller 22 and the wear ring in the housing 18 generally results in substantially greater flow rates and increased fountain heights with a three horsepower motor than using an open blade type propeller driven by a five horsepower motor. Competitive flow rates of 250 gallons per minute have been increased to 500 gallons per minute. When the flow straightener 24 is installed over the impeller 22, even greater fountain heights are obtained while still using a three horse power motor. For example, a 28 foot vertical height was increased to a 40 foot height due to the flow straightener 24.

It should now be apparent that the present invention provides a fountain aerator 10 which satisfies the objects and advantages set forth above. While the invention has been described with reference to a preferred embodiment, those skilled in the art will appreciate that certain substitutions, alterations and omissions may be made without departing from the spirit thereof. Accordingly, the foregoing description is meant to be exemplary only and it should not be deemed limitative on the scope of the invention as set forth with the following claims.

We claim:

1. A fountain aerator for propelling and aerating water comprising:

a flow tube for directing a flow of water;

a motor base assembly containing a motor provided with a rotatable output shaft;

an open ended housing having an inner wall having a first diameter, the housing being connected between the flow tube and the motor base assembly;

a wear ring secured within the housing and defining a central opening having a second diameter less than the first diameter; and a covered impeller retained in the housing in spaced relationship with the flow tube, and coupled to the motor output shaft for rotation therewith, the impeller having an upper wall and a lower wall interconnected by a number of radially extending blades, and a water admitting inlet depending from the lower wall and extending through the central opening of the wear ring for rotation therein, the upper wall, the lower wall and the blades defining a series of outlet passages in communication with the inlet, wherein the impeller creates centrifugal output streams of water when the motor output shaft rotates and the wear ring minimizes return flow of water through the inlet.

2. The fountain aerator of claim 1, wherein the impeller includes a central hub for receiving the motor output shaft, each of the blades being curved and having an inner end located between the hub and the inlet, and an outer end positioned between the upper wall and the lower wall.

3. The fountain aerator of claim 2, wherein each of the blades sweeps outwardly and upwardly from the inner end to the outer end.

4. The fountain aerator of claim 1 further comprising a float coupled to the flow tube for suspending the aerator in a body of water.

5. The fountain aerator of claim 4, wherein the flow tube has an upper end projecting above the float, and a lower end projecting beneath the float.

6. The fountain aerator of claim 5, wherein the motor base assembly includes a support stand extending upwardly therefrom.

7. The fountain aerator of claim 6, wherein the housing has a top open end connected to the lower end of the flow tube, and a bottom open end attached to the support stand.

8. The fountain aerator of claim 7, wherein the wear ring is secured within the bottom open end of the housing.

9. The fountain aerator of claim 1, wherein a bottom wall of the wear ring is substantially flush with a bottom end of the impeller outlet.

10. A fountain aerator for propelling and aerating water comprising:

a float having a flow tube extending therethrough for suspending the aerator in a body of water;

a motor base assembly containing a motor provided with a rotatable output shaft;

an open ended housing spaced from the float and connected between the flow tube and the motor base assembly;

a wear ring secured within the housing and defining a central opening therein;

a covered impeller retained in the housing in spaced relationship with the float and coupled to the motor output shaft for rotation therewith, the impeller having an upper wall and a lower wall interconnected by a number of radially extending blades, and a water admitting inlet depending from the lower wall and extending through the central opening for rotation therein, the upper wall, the lower wall and the blades defining a series of outlet passages in communication with the inlet, wherein the impeller creates centrifugal output streams of water when the motor output shaft rotates, and the wear ring minimizes return flow of water through the inlet; and a flow straightener spaced from the float and fixed to the housing in overlying, surrounding relationship with the impeller, the flow straightener having flow straightening slot structure overlapping the outlet passages of the impeller for propelling substantially vertical streams of water upwardly through the flow tube.

11. The fountain aerator of claim 10, wherein the flow straightener is crown-shaped and includes an upper portion and an outer wall encircling the upper portion, the upper portion being recessed to rotatably receive an enlarged top section of the impeller, and the outer wall being formed with a plurality of spaced apart, angularly and upwardly extending fingers defining the slot structure between adjacent pairs of fingers.

12. The fountain aerator of claim 11, wherein the outer wall has a lower, solid ring portion defining a bottom end of the flow straightener which rests upon the wear ring and lies adjacent an inner surface of a bottom end of the housing.

13. The fountain aerator of claim 12, wherein each finger has an angular segment disposed at generally a 45 degree angle relative to the bottom end of the flow straightener, and a vertical segment extending at generally a 90 degree angle relative to the bottom end of the flow straightener.

14. The fountain aerator of claim 13, wherein each finger has a width and a length which is greater then the width.

15. The fountain aerator of claim 13, wherein the angular segment of each finger has identically-shaped opposed surfaces which increase in depth as the angular segment progresses upwardly towards the vertical segment.

16. The fountain aerator of claim 13, wherein the vertical segment of each finger has opposed surfaces which diverge from each other in a radial direction.

17. The fountain aerator of claim 11, wherein the slot structure includes a number of flow straightening slots extending generally axially of a longitudinal axis of the flow straightener.

18. The fountain aerator of claim 17, wherein each of the slots has an angular portion and a vertical portion extending from the angular portion.

19. The fountain aerator of claim 18, wherein the angular portions of the slots overlie the outlet passages of the impeller.

20. The fountain aerator of claim 19, wherein the impeller blades have outer ends that extend across the angular portions of the slots.

21. A fountain aerator flow straightener adapted to straighten the centrifugal flow of water emanating from a rotatable impeller, the flow straightener comprising:

a crown-shaped body having a cylindrical upper portion and a cylindrical outer wall encircling the upper portion, the body being adapted to overlie and surround the impeller, the upper portion being recessed and adapted to rotatably receive an enlarged top section of the impeller, the outer wall being formed with a plurality of flow straightening, angularly and upwardly extending slots adapted to overlap outlet passages of the impeller, the slots being constructed and arranged to carry and transport increasing volumes of water as the paths of the slot proceed upwardly.

22. The flow straightener of claim 21, wherein the slots extend generally axially of a longitudinal axis of the flow straightener.

23. The flow straightener of claim 21, wherein the slots are formed by a number of flow straightening fingers.

24. The flow straightener of claim 23, wherein each finger has an angular segment disposed at a 45 degree angle relative to a bottom end of the flow straightener, and a vertical segment extending at generally a 90 degree angle relative to the bottom end of the flow straightener.

25. The flow straightener of claim 23, wherein each finger has a width and a length which is greater than the width.

26. The flow straightener of claim 24, wherein each angular segment of each finger has identically-shaped opposed surfaces which increase in surface area as the angular segment progresses upwardly towards the vertical segment.

27. The flow straightener of claim 26, wherein each vertical segment of each finger has opposed surfaces which diverge from each other in a radial direction.

28. The flow straightener of claim 21, wherein each slot has an angular portion and a vertical portion extending from the angular portion.

29. The flow straightener of claim 27, wherein each angular segment opposed surface is connected to each vertical segment opposed surface by a radiused area.

* * * * *